US006375474B1

(12) United States Patent
Harper, Jr. et al.

(10) Patent No.: US 6,375,474 B1
(45) Date of Patent: Apr. 23, 2002

(54) MEZZANINE STYLE ELECTRICAL CONNECTOR

(75) Inventors: Donald K. Harper, Jr.; Steven K. Forman, both of Harrisburg, PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/630,619

(22) Filed: Aug. 2, 2000

Related U.S. Application Data

(60) Provisional application No. 60/147,807, filed on Aug. 9, 1999.

(51) Int. Cl.[7] ..... H01R 9/09
(52) U.S. Cl. ..... 439/66; 439/81
(58) Field of Search ..... 439/66, 65, 81, 439/91, 885, 660, 246

(56) References Cited

U.S. PATENT DOCUMENTS

| | | | | |
|---|---|---|---|---|
| 5,152,695 | A | 10/1992 | Grabbe et al. | 439/71 |
| 5,173,055 | A | 12/1992 | Grabbe | 439/66 |
| 5,228,861 | A | 7/1993 | Grabbe | 439/66 |
| 5,462,440 | A | 10/1995 | Rothenberger | 439/66 |
| 5,484,295 | A | 1/1996 | Mowry et al. | 439/66 |
| 5,498,166 | A | 3/1996 | Rothenberger | 439/66 |
| 5,653,598 | A | 8/1997 | Grabbe | 439/66 |
| 5,913,687 | A | 6/1999 | Rathburn | 439/66 |

FOREIGN PATENT DOCUMENTS

| | | |
|---|---|---|
| EP | 0906007 A2 | 3/1999 |
| WO | WO99/38229 | 7/1999 |

*Primary Examiner*—Tho D. Ta
*Assistant Examiner*—Ann McCamey
(74) *Attorney, Agent, or Firm*—Perman & Green, LLP

(57) ABSTRACT

An electrical connector comprising a housing having a first surface and a second surface; and a contact secured to the housing. The contact comprises a mounting section connected to the housing and, a first arm and a second arm extending from the mounting section. The mounting section comprises an aperture and a slit through the contact from the aperture and between the first and second arms. The first arm extends towards the first surface and the second arm extends towards the second surface.

20 Claims, 7 Drawing Sheets

FIG. 1a
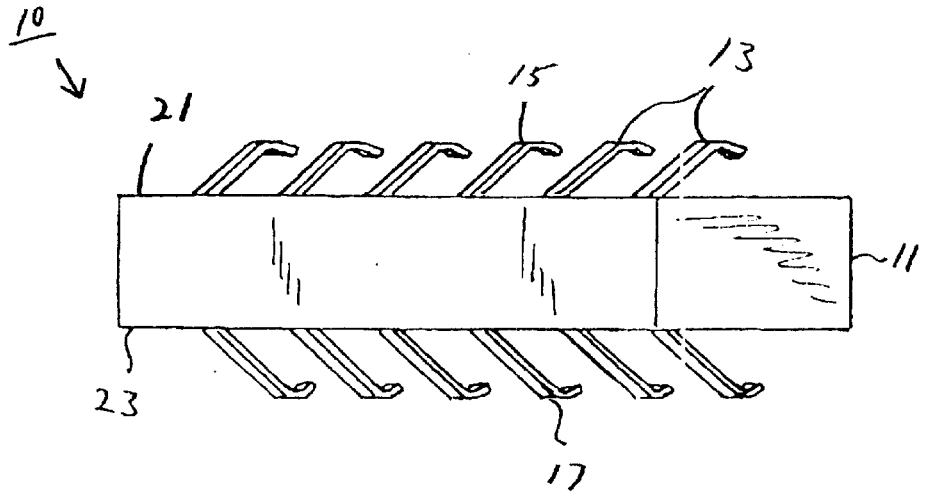
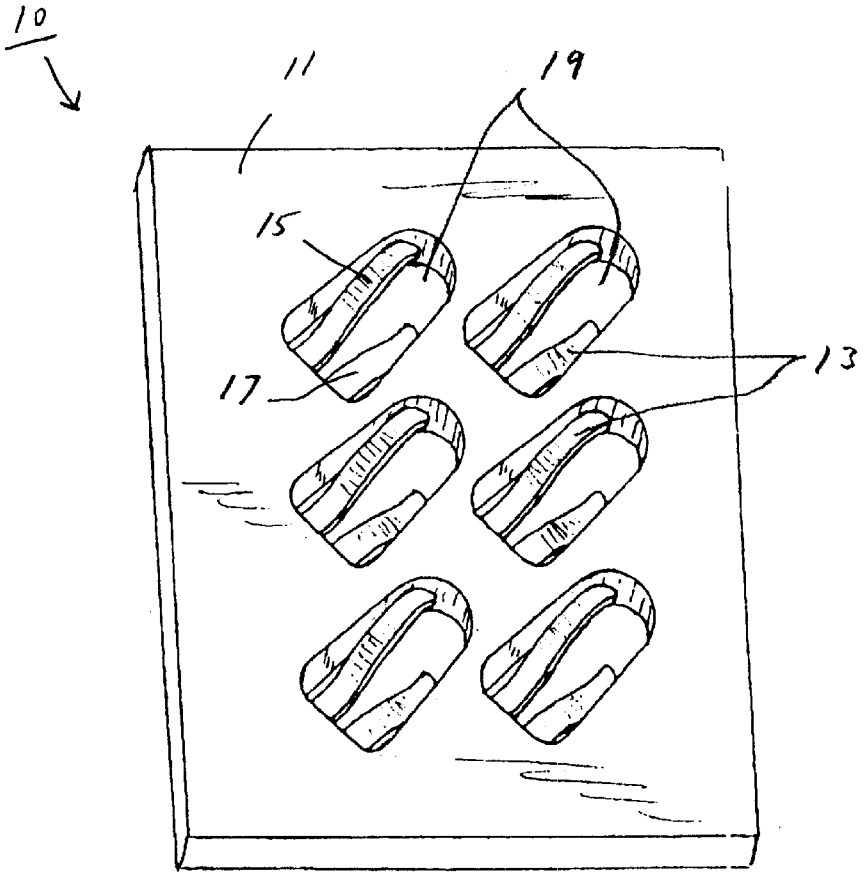
FIG. 1b

MEZZANINE STYLE ELECTRICAL CONNECTOR

CROSS-REFERENCE TO RELATED APPLICATION

This application claims the benefit under 35 U.S.C. §119 (e) of U.S. provisional patent application No. 60/147,807 filed Aug. 9, 1999.

BACKGROUND OF THE INVENTION

1. Field of the Invention

The present invention relates to electrical connectors. More specifically, the present invention relates to an electrical connector positioned between a first electrical component and a second electrical component.

2. Brief Description of Earlier Developments

U.S. Pat. No. 5,462,440 discloses an electrical connector having contact fingers in openings of a housing which are bent in different directions. European Patent Application number EP 0906007 describes a multipin connector with a dielectric housing overmolded about a lead frame of contacts. The overmolding step embeds a central portion of each contact within the dielectric housing leaving opposed arms to extend through openings directed towards opposite sides of the housing. While perhaps suitable for the specific application discussed in European Patent Application EP 0906007, the connector described above may not be adequate in other applications, such as high density applications. There is a need for an electrical connector which can be positioned between two opposing electrical components which has a high density and high input/output count contact array. There is a need for such an electrical connector design which provides a short electrical path of contact geometry for good electrical performance and, which short contact geometry can provide a low mated height between the electrical components.

SUMMARY OF THE INVENTION

It is an object of the present invention to provide an electrical connector having a low mated height.

It is a further object of the present invention to provide an electrical connector capable of use high density applications.

It is a further object of the present invention to provide an electrical connector capable of use in high input/output (I/O) count applications.

It is a further object of the present invention to provide an electrical connector with suitable electrical performance characteristics.

It is a further object of the present invention to provide an electrical connector with contacts having a short electrical path.

These and other objects of the present invention are achieved in one aspect of the present invention by an electrical connector, comprising: a housing having a first surface and a second surface; and a contact secured to the housing and having a first arm and a second arm. The first arm extends towards the second surface.

These and other objects of the present invention are achieved in another aspect of the present invention by an electrical connector, comprising: a housing including: a first surface; a second surface; and an opening; and a contact residing within the opening, movable within the opening, and including: a first arm extending towards the first surface; and a second arm extending towards the second surface.

BRIEF DESCRIPTION OF THE DRAWINGS

Other uses and advantages of the present invention will become apparent to those skilled in the art upon reference to the specification and the drawings, in which:

FIG. 1*a* is a perspective view of one alternative embodiment of an electrical connector of the present invention;

FIG. 1*b* is a side view of the electrical connector in FIG. 1*a;*

FIG. 7 is a perspective view of a contact used in the electrical connector in FIG. 6*a.

DETAILED DESCRIPTION OF THE PREFERRED EMBODIMENTS

Figure 2:
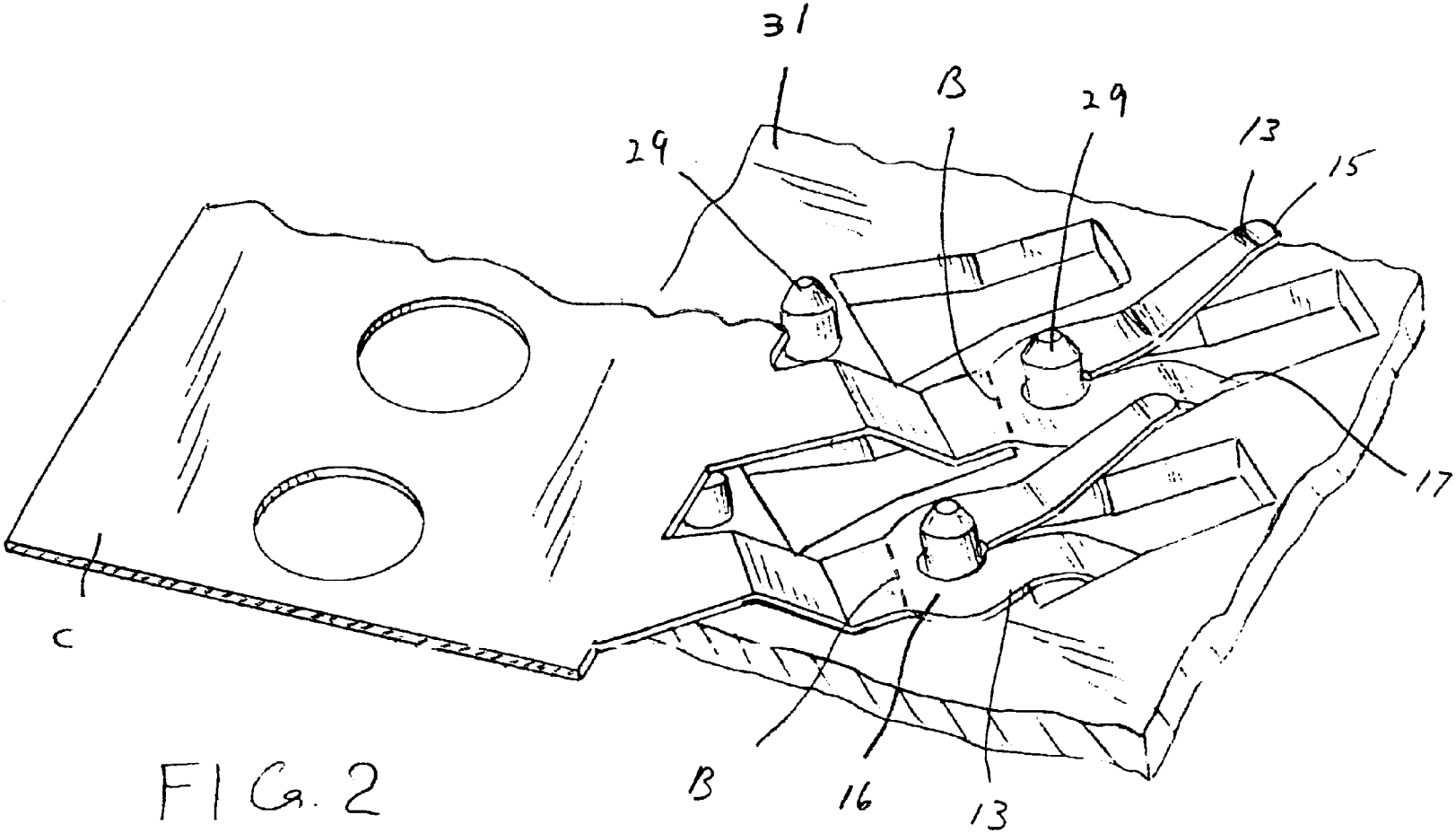
FIG. 2 is a perspective view of the electrical connector in FIG. 1*a* partially assembled.
Figure 3:
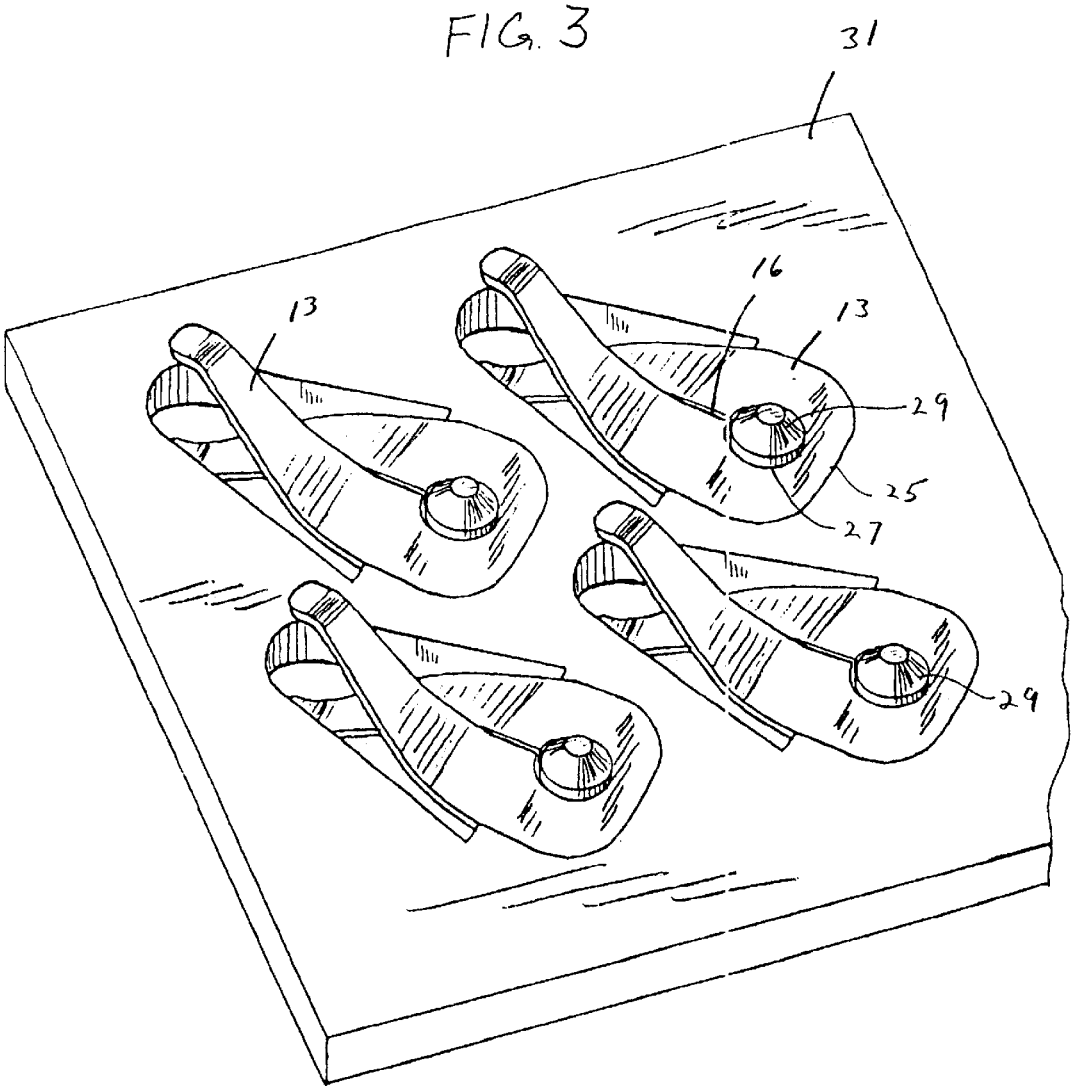
FIG. 3 is a perspective view of the electrical connector in FIG. 1*a* partially assembled.
Figure 4:
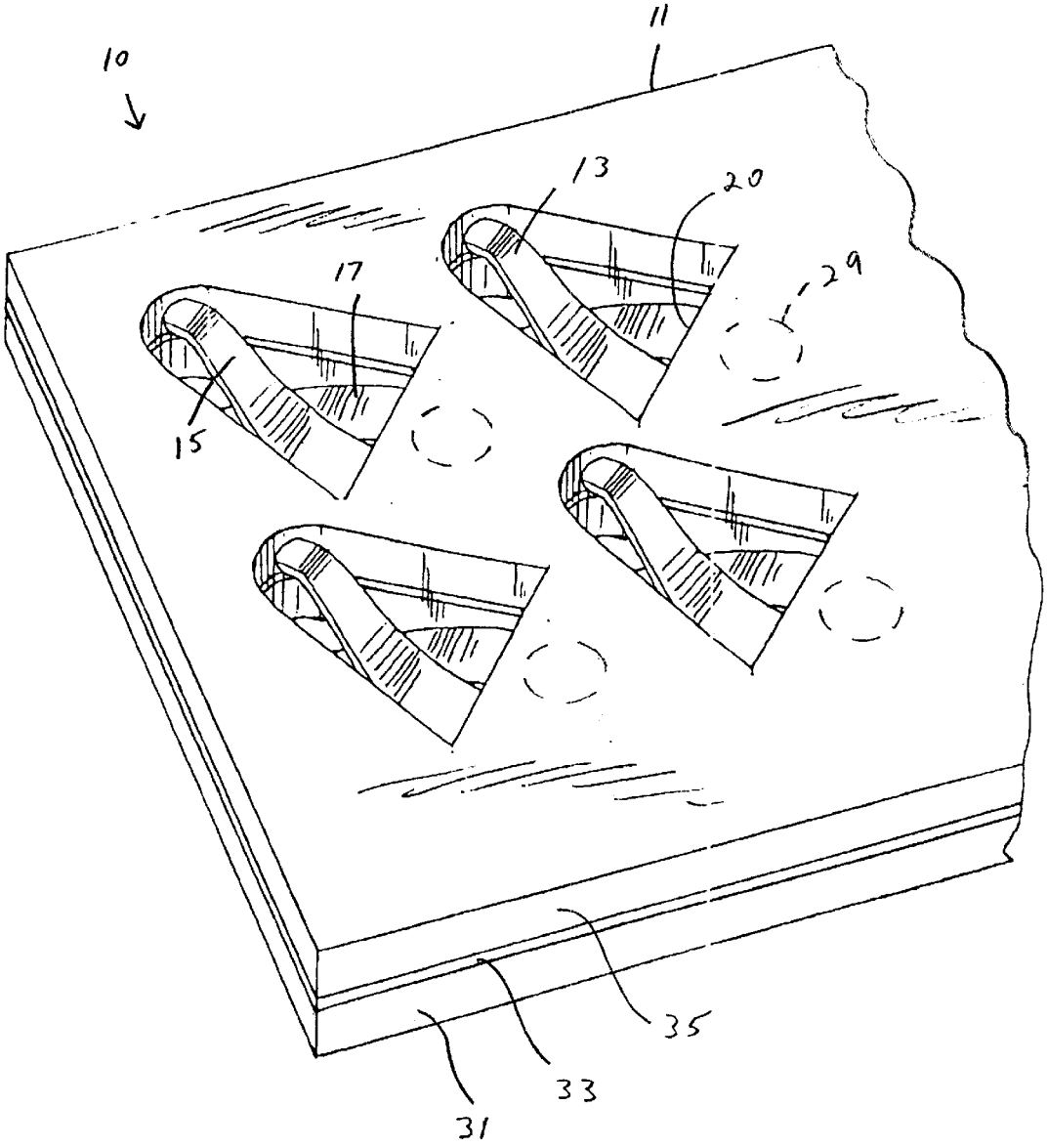
FIG. 4 is a perspective view of the electrical connector in FIG. 1*a* partially assembled.
Figure 5:
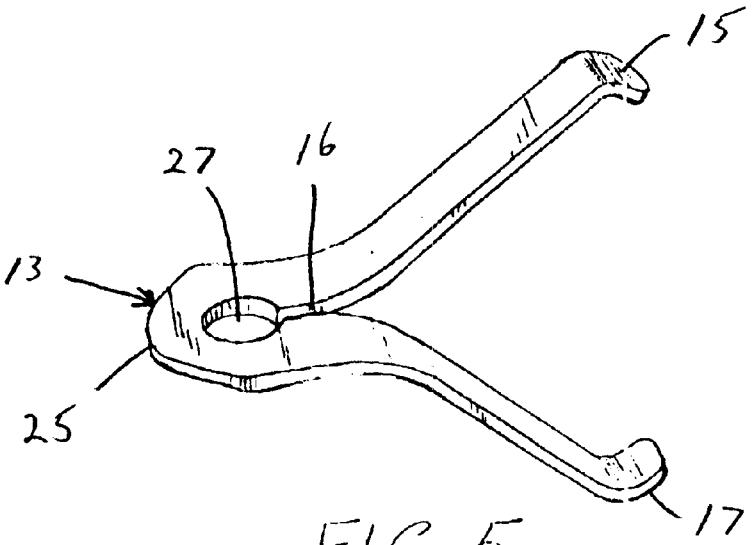
FIG. 5 is a perspective view of a contact used in the electrical connector in FIG. 1*a;*

FIGS. 1–5 display a first alternative embodiment of the present invention. FIGS. 1*a* and 1*b* display an electrical connector 10 which includes a base 11 and contacts 13. Contacts 13 can be arranged diagonally on base 11. As illustrated by FIG. 2, contacts 13 are preferably stamped and formed with a carrier strip C made from a suitable conductive material such as a copper alloy. As seen in FIG. 5, each contact 13 preferably has intermediate section or mounting section 25 and dual cantilever arms 15, 17 which project from a common edge or side of the mounting section 25. The mounting section 25 preferably comprises an aperture 27. The two arms 15, 17 extend from the same side of the mounting section 25 in general opposite directions. In this embodiment the contacts 13 each have a general wish-bone shape. However, any suitable shape could be provided. The contacts 13 each preferably include a slit 16 which extends from the aperture 27 between the two arms 15, 17. The contacts 13 are connected to a same side of the carry strip C and are severed from the carry strip C at break point B illustrated in FIG. 2 during assembly with the base 11.

Arms 15, 17 extend into opening 19 when base 11 and contacts 13 are assembled to form connector 10. Arm 15 extends upwardly through opening 19 and past a top face 21 of base 11, while arm 17 extends downwardly through opening 19 past a bottom face 23 of base 11. When mating with a first electrical component, such as a land grid array (LGA) package, and a second electrical component, such as a printed circuit board (PCB), arms 15, 17 deflect towards base 11. In other words, connector 10 is a Z-axis connector. The intermediate section 25 resides within base 11. During assembly of connector 10, aperture 27 preferably engages a peg 29 extending from a plate 31. Plate 31 could include a lower conductive shield (not shown). In this embodiment the aperture 27 is about the same size and shape as the peg 29.

However, in alternate embodiments any suitable relationship of sizes and shapes could be provided. Preferably, the mounting section 25 makes an interference fit with the peg 29 in the aperture 27. This allows the contacts 13 to stay in place during removal of the carry strip C and attachment of the layers 33, 35. However, in alternate embodiments any suitable temporary or intermediate holding means for the contacts could be provided. In order to assist in providing a good intermediate holding, but prevent possible damage in mounting the contacts 13 to the pegs 29, the slits 16 have been provided. The slits 16 allow the apertures 27 to enlarge slightly during attachment of the mounting sections 25 to the pegs 29. Thus, the mounting sections 25 can form a compression, friction engagement with the pegs 29. The pegs 29 could also have a recess (not shown) which the mounting sections 25 snap into. The arms 15, 17 are not significantly outwardly deflected to cause interference with their deflectability relative to the base 11. When the layers 33, 35 are attached to layer 31, the effective spring lengths of the arms 15, 17 can be terminated at rear 20 of openings 19 (see FIG. 4). Alternatively, the effective spring lengths can be longer if the stationary sandwiching of the contacts 13 is located further back towards the peg 29.

Plate 31, along with other layers described below, form base 11. Once securely mounted to posts 29, contacts 13 can be severed from carrier strip C as shown in FIG. 3. As seen in FIG. 4, a dielectric layer 33, such as KAPTON, followed by a conductive shield 35 can then be placed on plate 31 to form base 11. Other types of materials, along with different arrangements of materials, however, could be used to form base 11. Preferably, mounting sections 25 of the contacts 13 are rigidly secured to base 11. Preferably, the top ends of the posts 29 can be used to at least partially connect the dielectric layer 33 and shield 35 to the plate 31. Mounting section 25 is preferably stationarily captured between the layers 31 and 33, 35.

Figure 6A:
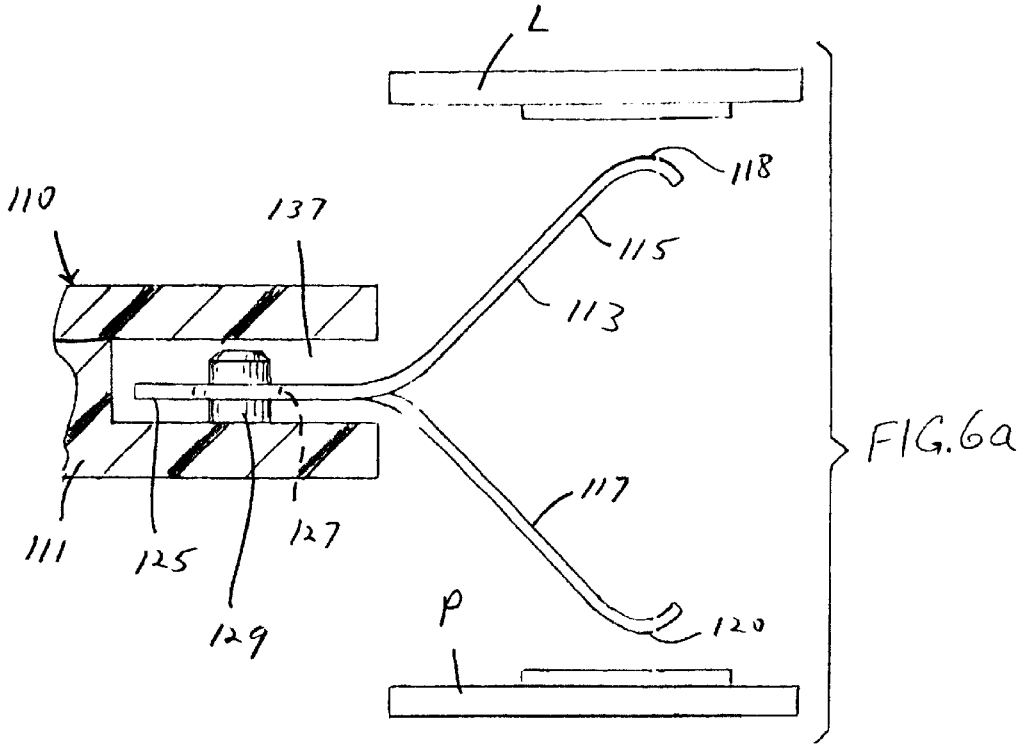
FIG. 6*a* is a cross-sectional view of another alternative embodiment of an electrical connector of the present invention in an unmated position.
Figure 6B:
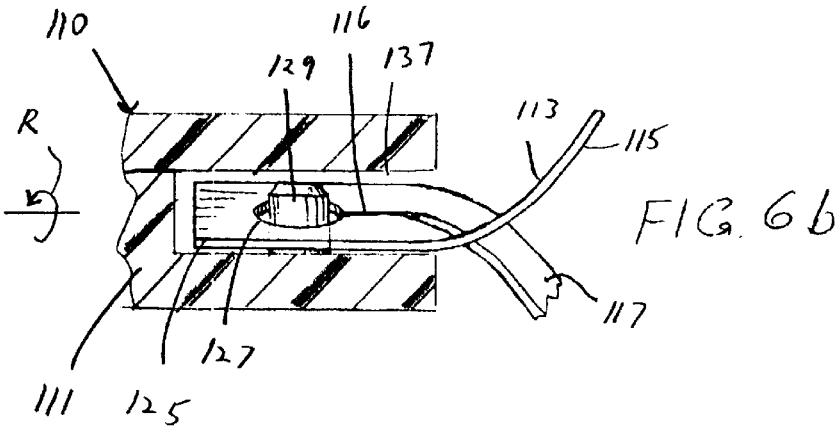
FIG. 6*b* is a cross-sectional view the electrical connector in FIG. 6*a* in a partially mated position.
Figure 6C:
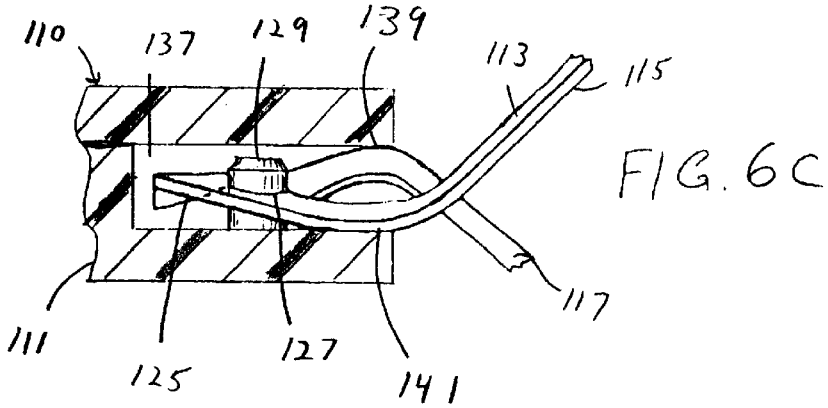
FIG. 6*c* is a cross-sectional view of the electrical connector in FIG. 6*a* in a fully mated position.

FIGS. 6*a–c* display another alternative embodiment of the present invention. As shown in FIG. 6*a,* electrical connector 110 includes a base 111 and contacts 113. Similar to the first embodiment, contacts 113 include dual cantilever beams 115, 117 extending past opposite sides of base 111. Also similar to the first embodiment, intermediate section 125 also includes an aperture 127 that engages a peg 129 on base 111. Differently, however, than the first embodiment, base 111 does not rigidly support contact 113. Intermediate section 125 of contact 113 resides within a chamber 137 formed in base 111. Chamber 137 has a height greater than the thickness of contact 113. In addition, the diameter of peg 129 is smaller than the diameter of aperture 127. Thus, contact 113 can move within chamber 137 and about peg 129.

FIG. 6*a* demonstrates connector 110 before mating with LGA component L and PCB P. Typically, intermediate section 125 of contact 113 is generally coplanar with chamber 137 of base 111. FIG. 6*b* demonstrates connector 110 during initial mating with LGA component L and PCB P. In this condition, contact 113 begins to rotate within chamber 137 and about peg 129 as illustrated by arrow R due to the deflection of contact 113. This is caused by arm 15 rotating down and arm 17 rotating up in an opposite direction. Intermediate section 125 axially rotates in chamber 137. During this initial mating, the entire length of contact 113 acts as a spring arm. FIG. 6*c* demonstrates connector 110 fully mated with LGA component L and PCB P. As connector 110 approaches the fully mated position shown in FIG. 6*c,* medial portions 139, 141 of contact 113 abut the walls that define chamber 137. This prevents further rotation of contact 113 within chamber 137 and serves to reduce the effective spring length of contact 113. The deflection of the arms 15, 17 after the medial portions 139, 141 contact the walls of the chamber 137 causes the intermediate mounting section 125 to twist as shown. The combination of rotation of the contact and movement of the contact areas 118, 120 on the contacts of components L, P from twisting of mounting section 125, can provide good contact wipe at areas 118, 120. Slit 116 helps to allow sections behind medial portions 139, 141 to move relative to each other.

Figure 7:
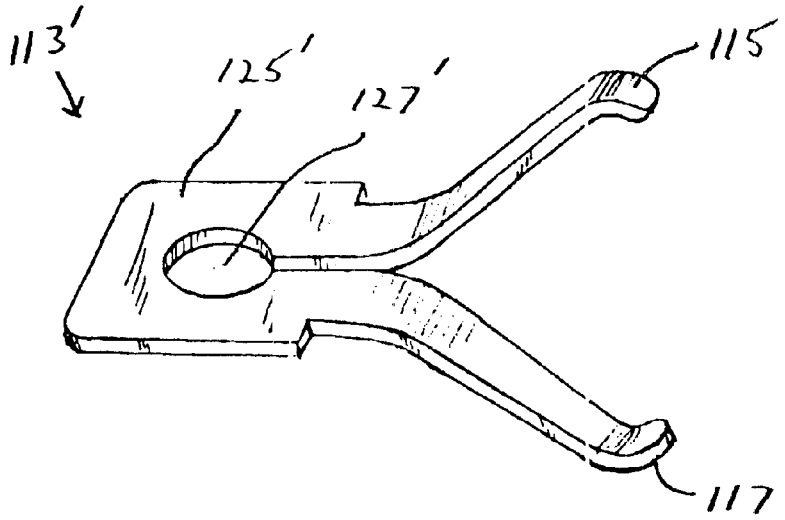

FIG. 7 illustrates another alternative embodiment of the present invention. In this embodiment the contact 113' has an enlarged mounting section 125' in order to accommodate an enlarged aperture 127'. However, any suitably sized or shaped mounting section or aperture could be provided.

Figure 8A:
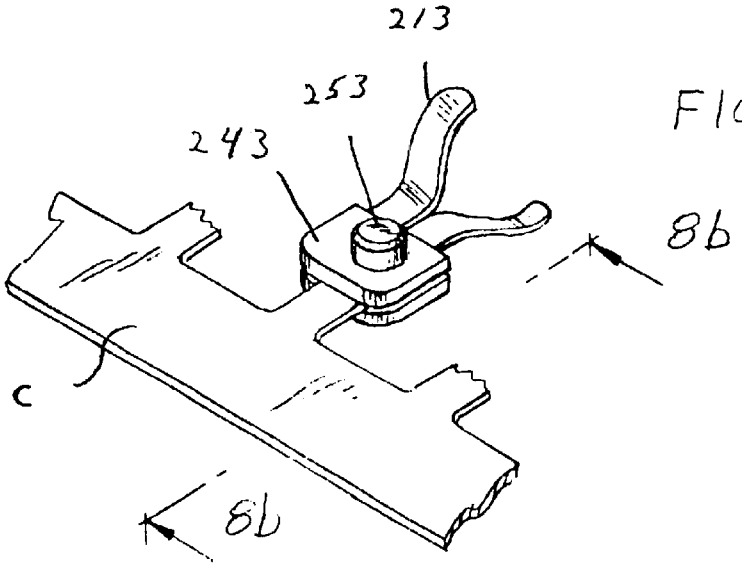
* and FIGS. 8*a*–8*c* demonstrate various steps in the assembly of another alternative embodiment of the present invention.
Figure 8B:
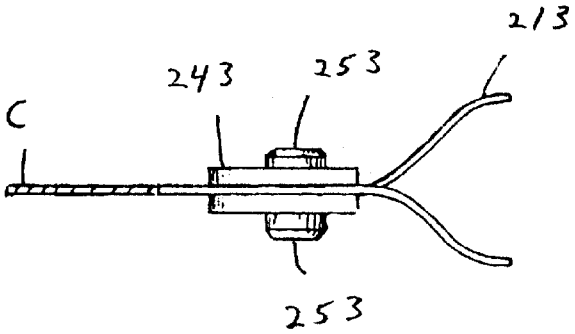
Figure 8C:
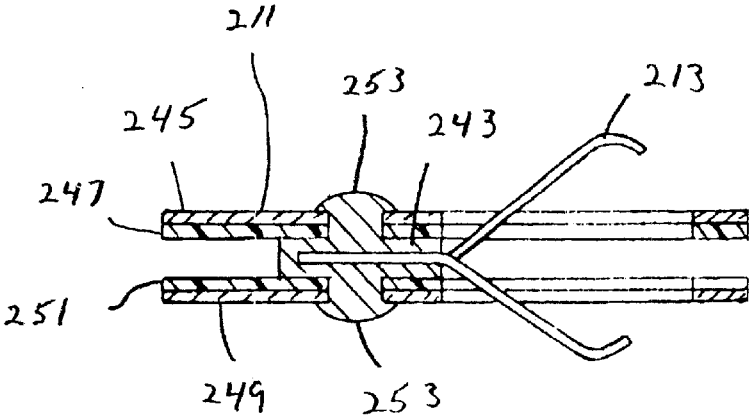

FIGS. 8*a–*8*c* demonstrate another alternative embodiment of the present invention. In this embodiment, a plastic portion 243 could be overmolded around contact 213 while on carrier strip C. As seen in FIG. 8C, once contact 213 and plastic portion 243 are severed from carrier strip C, an upper conductive shield 245, an upper dielectric layer 247, a lower conductive shield 249 and a lower dielectric layer 251 are placed on respective pegs 253. Pegs 253 of the overmolded portion 243 are then, for example, heat staked to retain upper shield 245, upper dielectric layer 247, lower shield 249 and lower dielectric layer 251 on plastic portion 243. Plastic portion 243, upper shield 245, upper dielectric layer 247, lower shield 249 and lower dielectric layer 251 form base 211.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector, comprising:

a housing having a first surface and a second surface; and a contact secured to the housing, the contact comprising a mounting section connected to the housing and, a first arm and a second arm extending from the mounting section, the mounting section comprising an aperture and a slit through the contact from the aperture and between the first and second arms, wherein the first arm extends towards the first surface and the second arm extends towards the second surface.

2. A connector as in claim 1, wherein the first arm and the second arm extent from a common edge of the mounting section.

3. A connector as in claim 1 wherein the mounting section is rigidly secured to the housing.

4. A connector as in claim 1 wherein the mounting section is movably secured to the housing.

5. A connector as in claim 1 wherein the housing comprises a peg and wherein the mounting section is mounted on the peg with the peg extending through the aperture.

6. A connector as in claim 1 wherein the housing comprises a plate, a dielectric layer and a conductive shield, and wherein the mounting section of the contact is insulated from the conducive shield by the dielectric layer.

7. A connector as in claim 1 wherein the contact comprises a general wish-bone shape.

8. A connector as in claim 1 wherein the connector comprises a plurality of the contacts being aligned in any array on the housing, the array comprising the first and second arms extending from their respective mounting sections in a same direction relative to the housing.

9. A connector as in claim 1 wherein the contacts are comprised of a stamped and formed flat metal member with the contacts being located on a same side of a carry strip attached to the mounting section and having their respective first and second arms pointing in a same direction away from the carry strip, the carry strip being removed after the contacts are secured to the housing.

10. A connector as in claim 1 wherein the contact comprises a plastic portion overmolded around the mounting section.

11. A connector as in claim 10 wherein the contact comprises at least one conductive shield mounted to the contact by the plastic portion.

12. A connector as in claim 10 wherein the plastic portion comprises pegs extending in opposite directions from the mounting section.

13. An electrical connector, comprising:

a housing including:

a first surface, a second surface, and an opening; and a contact residing within the opening and being movable within the opening, the contact including:

a first arm extending towards the first surface; and a second arm extending towards the second surface, wherein the contact comprises a mounting section and the first and second arms extend from the mounting section, the mounting section being movably located in a chamber section of the opening in the housing, wherein the mounting section comprises an aperture and a section of the housing is located in the aperture, and wherein the mounting section can move relative to the housing along the section of the housing in the aperture.

14. An electrical connector as in claim 13, wherein the contact is rotatable within the opening.

15. An electrical connector as in claim 13 wherein the mounting section is twistable in the chamber section.

16. An electrical connector as in claim 15 wherein the contact is rotatable in the chamber section.

17. An electrical connector as in claim 16 wherein the first and second arms comprise portions which are movable into contact with portions of the housing at the chamber section.

18. A method of assembling an electrical connector comprising steps of:

positioning a contact in a contact receiving area of a housing of the electrical connector, the step of positioning comprising locating a mounting section of the contact in a chamber of the housing and locating arms of the contact in an opening through the housing; and connecting the mounting section of the contact to the housing in the chamber, the step of connecting comprising movably mounting the mounting section on a post of the housing wherein the mounting section is movable along the post relative to the housing.

19. A method as in claim 18 wherein the post of the housing is located inside the chamber.

20. A method as in claim 18 wherein the mounting section has a substantially planar shape along a mounting section plane, and the step of connecting comprises movably mounting the mounting section to the housing along an axis substantially perpendicular to the mounting section plane.

* * * * *